US006679643B1

(12) United States Patent
Ham

(10) Patent No.: US 6,679,643 B1
(45) Date of Patent: Jan. 20, 2004

(54) DEVICE FOR JOINTING POLES OF TENT

(75) Inventor: Se Il Ham, Inchun (KR)

(73) Assignee: Northpole Unlimited, Tsim Sha Tsui (KR)

( * ) Notice: Subject to any disclaimer, the term of this patent is extended or adjusted under 35 U.S.C. 154(b) by 39 days.

(21) Appl. No.: 10/159,180

(22) Filed: May 31, 2002

(30) Foreign Application Priority Data

Mar. 11, 2002 (KR) ..... 2002-0007108

(51) Int. Cl.[7] ..... E04H 15/00
(52) U.S. Cl. ..... 403/102; 403/84; 135/126
(58) Field of Search ..... 403/102, 101, 403/103, 61, 83, 84; 135/126, 135

(56) References Cited

U.S. PATENT DOCUMENTS 5,195,551 A * 3/1993 Ju ..... 135/126
5,681,045 A * 10/1997 Liao ..... 403/84 X
5,884,646 A * 3/1999 Ju ..... 135/135
6,200,060 B1 * 3/2001 Vernay ..... 403/101 X

FOREIGN PATENT DOCUMENTS

KR 20-1999-0019658 12/1999

* cited by examiner

*Primary Examiner*—John R. Cottingham
(74) *Attorney, Agent, or Firm*—Schmeiser, Olsen & Watts LLP

(57) ABSTRACT

Disclosed herein is a device for jointing poles of a tent. The device has a housing and a rotor body. In this case, the housing consists of a first pole insert hole for receiving a pole, a seat slit in which the rotor body is seated, and a locking recess formed on each sidewall of the seat slit. The rotor body consists of a longitudinal hinge hole receiving a hinge pin therein such that the rotor body seated in the seat slit of the housing is rotatably jointed to the housing. A locking lug is inserted into an associated locking recess of the housing to limit rotation of the rotor body. A second pole insert hole receives another pole. Furthermore, the device includes a unit for automatically releasing the rotor body from the housing. The automatic releasing unit consists of an elastic member mounted by a locking member to an end wall provided at the inside end of the seat slit. The elastic member allows the locking lugs of the rotor body to be automatically removed from the locking recesses of the housing when collapsing the tent.

1 Claim, 8 Drawing Sheets

DEVICE FOR JOINTING POLES OF TENT

BACKGROUND OF THE INVENTION

1. Field of the Invention

The present invention relates generally to a device for jointing poles of a tent, and more particularly, to a pole jointing device for tents, which is used to joint a plurality of poles to each other to form a pole assembly which is inserted into pole assembly insert pockets sewn to the outer circumferential surface of the main body of a tent in order to obtain a desired shape when the tent is pitched, and which has a unit for automatically releasing the pole jointing device from its locking state when collapsing the tent, thus preventing the pole jointing device from being damaged.

2. Description of the Prior Art

Typically, tents have been designed to have a dome shape or a tunnel shape with a plurality of pole assemblies. Recently, demand has increased for a pole jointing device which allows the poles to be easily and simply connected to and disconnected from each other as well as prevents the tent from being deformed in its shape by an external force.

FIG. 1 shows a conventional tent having a tunnel shape, when the tent is pitched. In this tent, a plurality of pole assembly insert pockets 1*a* are sewn to the outer circumferential surface of a main body 1. In this case, the pole assemblies 2 are inserted into the pockets 1*a* in order that the tent may maintain a desired shape, that is, the tunnel shape. Each pole assembly 2 is formed by coupling a plurality of poles 2*a* with each other. The end of each pole is firmly connected to a rotor block 4 which is rotatable about a hinge 3*a* of a coupling member 3.

When it is required to pitch the tent 1, the pole assemblies 2 inserted in the pockets 1*a* sewn to the outer circumferential surface of the main body 1 are stretched. Then, all poles 2*a* forming each pole assembly 2 are rotated about the hinges 3*a* of the coupling members 3 such that the main body 1 of the tent forms a tunnel shape.

In the case where the tent 1 is pitched, when an external force is applied to the pole jointing parts of the pole assemblies 2, or the coupling members 3 installed at the ends of the poles 2*a*, the rotor blocks 4 connected to the coupling members 3 are rotated. On the contrary, when the external force is removed, the rotor blocks 4 are returned to their original positions by the elasticity of both the pockets 1*a* and the main body 1. In this way, the main body 1 of the tent can maintain the tunnel shape.

As described above, in the case where a relatively weak external force is applied to a coupling member 3, the pole assembly 2 can return to its original position. But, when a relatively strong external force, that is, force enough to rotate the rotor blocks 4 of the two neighboring coupling members 3, is applied to the coupling members 3, the poles 2*a* move toward the main body 1. At this time, even if the external force is removed, the poles 2*a* cannot return to their original positions. Thus, the conventional tent has a problem in that it is complicated to pitch the tent, because a user must adjust the main body 1 to have the tunnel shape while pulling the poles 2*a* inside and/or outside the tent such that the poles 2*a* are returned to their original positions.

In order to solve the problem, there has been proposed Korean Utility Model No. 0172539, which was filed to KIPO under U.M. Application No. 1999-0019685, and was registered on Dec. 13, 1999, and is titled "DEVICE FOR JOINTING POLES OF A PORTABLE TENT". This pole jointing device is shown in FIGS. 2*a* to 2*c*.

FIG. 2*a*, FIG. 2*b*, and FIG. 2*c* are, respectively, an exploded perspective view, a perspective view, and a plan view of the conventional pole jointing device. As shown in the drawings, the pole jointing device 10 according to the Utility Model No. 0172539 includes a housing 20 which is provided at its one end with a first pole insert hole 21 for receiving a pole 2*a* forming a pole assembly. A seat slit 22 is formed on the housing 20 in such a way as to be opposite to the pole insert hole 21. Further, two locking recesses 23 are formed on both sidewalls of the seat slit 22.

In the seat slit 22 is seated a rotor body 30. The rotor body 30 is provided with a longitudinal hinge hole 31 for receiving a hinge pin 40 which is used to joint the rotor body 30 to the housing 20. Two locking lugs 32 are integrally formed on both sidewalls of the rotor body 30, and are respectively inserted into the two locking recesses 23 formed on the housing 20. The rotor body 30 is provided at its one end with a second pole insert hole 33 for receiving another pole 2*a*.

FIG. 3 is a front view of the tent, which is pitched by the pole assemblies each having been assembled by the conventional pole jointing device. As shown in FIG. 3, the pole assembly 2 is formed by jointing a plurality of poles 2*a*. In this case, two coupling members 3 and two pole jointing devices 10 are alternately installed on the pole assembly 2 at positions where the poles 2*a* are coupled to each other. In this case, the coupling member 3 is rotatable at both ends while the pole jointing device 10 is rotatably hinged at one end. Particularly, the pole jointing device 10 is installed at the jointing area of the poles 2*a* adjacent to the ground surface. The process of pitching the main body 1 of the tent using the pole assemblies 2, each of which is formed by two coupling members 3 and two pole jointing devices 10 is as follows. First, the rotor body 30 is inserted into the housing 20. At this time, the locking lugs 32 formed on the rotor body 30 are each fitted into an associated locking recess 23 of the housing 20, thus preventing an unexpected movement of the pole assembly 2. In such a way, as shown in FIG. 3, the tent is set up to have a tunnel shape.

When the external force is applied to the jointing area of the pole assembly 2 supporting the main body 1 of the tent, that is, the coupling member 3 and the pole jointing device 10 which are connected to the end of the pole 2*a*, the pole jointing device 10 is hinged, causing the external force to be transmitted to the coupling member 3 adjacent to the pole jointing device 10. At this time, the rotor block 4, mounted to the coupling member 3, is rotated. On the other hand, when the external force is removed from the coupling member 3, the rotor block 4 is returned to its original position from a rotated position by the elasticity of both the main body 1 and the pocket 1*a*. In this way, the tent 1 maintains the tunnel shape.

The pole jointing device 10 allows the tent to be invariable in its shape, thus preventing the pole assembly from folding.

Further, when removing the pole connecting force from the pole assembly 2 to collapse the main body 1 of the tent, the rotor block 4 of each coupling member 3 is rotated while the rotor body 30 inserted into the ho sing 20 of the pole jointing device 10 is pulled out from the housing 20 along the longitudinal hinge hole 31. At this time, the locking lugs 32 formed on the rotor body 30 are removed from the locking recesses 23, so the rotor body 30 rotates about the hinge part, thus collapsing the tent.

However, the conventional pole jointing device has a problem in that it is complicated to collapse the tent, beta se the rotor body 30 must be rotated after the locking lugs 32 are removed from the locking recesses 23 of the housing 20 when the tent's collapse is required.

The conventional pole jointing device has another problem in that the locking lugs 32 and locking recesses 23 may be damaged if a user rotates the rotor body 30 without the locking lugs 32 being removed from the locking recesses 23, so the broken pole jointing device has to be replaced with a new one, thus resulting in additional expense.

SUMMARY OF THE INVENTION

Accordingly, the present invention has been made keeping in mind the above problems occurring in the prior art, and an object of the present invention is to provide a device for jointing poles of a tent, which is designed to automatically remove locking lugs from locking recesses, different from the conventional pole jointing device that is designed such that the locking lugs must be removed from the locking recesses of a housing before rotating a rotor body to collapse the tent, and which thus prevents the locking lugs and the locking recesses from being damaged when rotating the rotor body without the locking lugs being removed from the locking recesses.

In order to accomplish the above object, the present invention provides a device for jointing poles of a tent, comprising a housing consisting of a first pole insert hole for receiving a pole, a seat slit in which a rotor body is seated, and a locking recess formed on each sidewall of the seat slit; and a rotor body consisting of a longitudinal hinge hole receiving a hinge pin therein such that the rotor body seated in the seat slit of the housing is rotatably jointed to the housing, a locking lug inserted into an associated locking recess of the housing to limit the rotation of the rotor body, and a second pole insert hole for receiving another pole, further comprising: a unit for automatically releasing the rotor body from the housing, the automatic releasing unit consisting of an elastic member mounted by a locking member to an end wall provided at the inside end of the seat slit, with the elastic member allowing the locking lugs of the rotor body to be automatically removed from the locking recesses of the housing when collapsing the tent.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
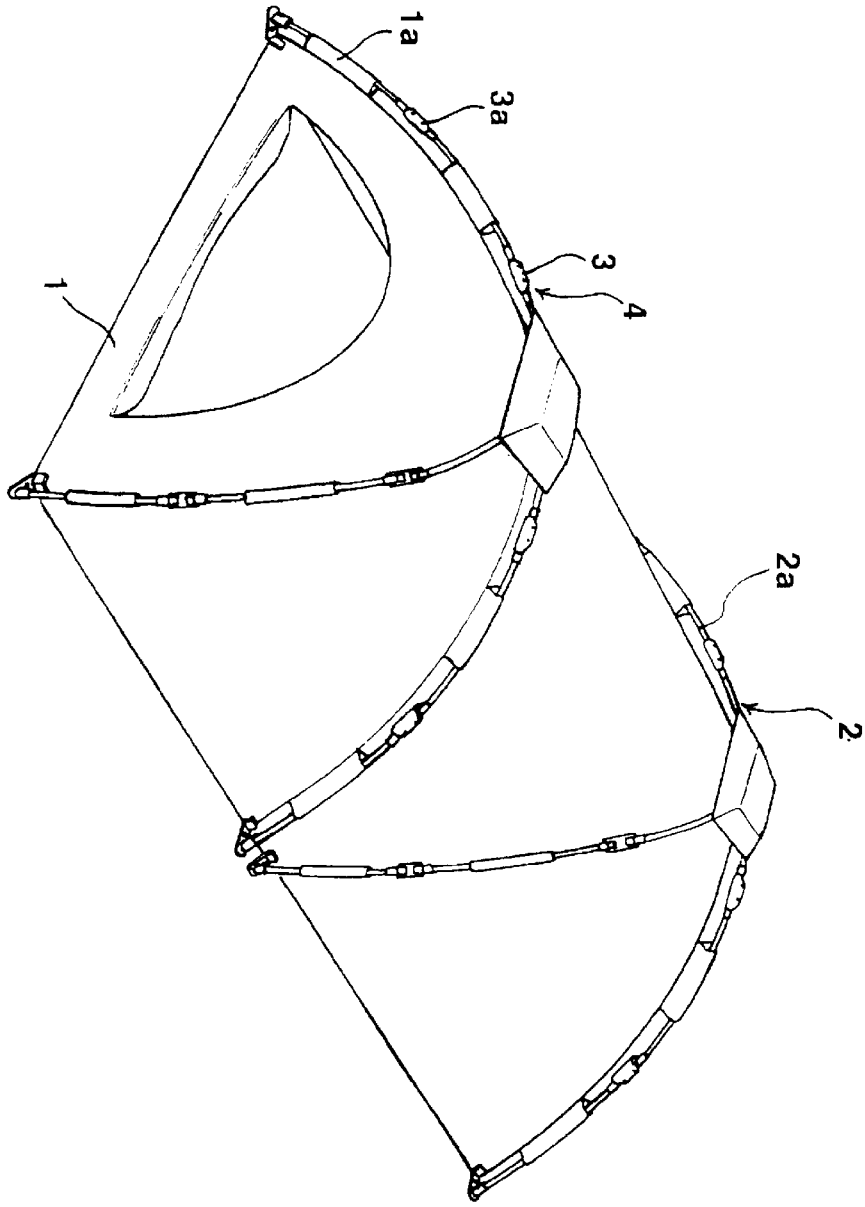
FIG. 1 is a perspective view showing a conventional tent, in which the tent is pitched.
Figure 2A:
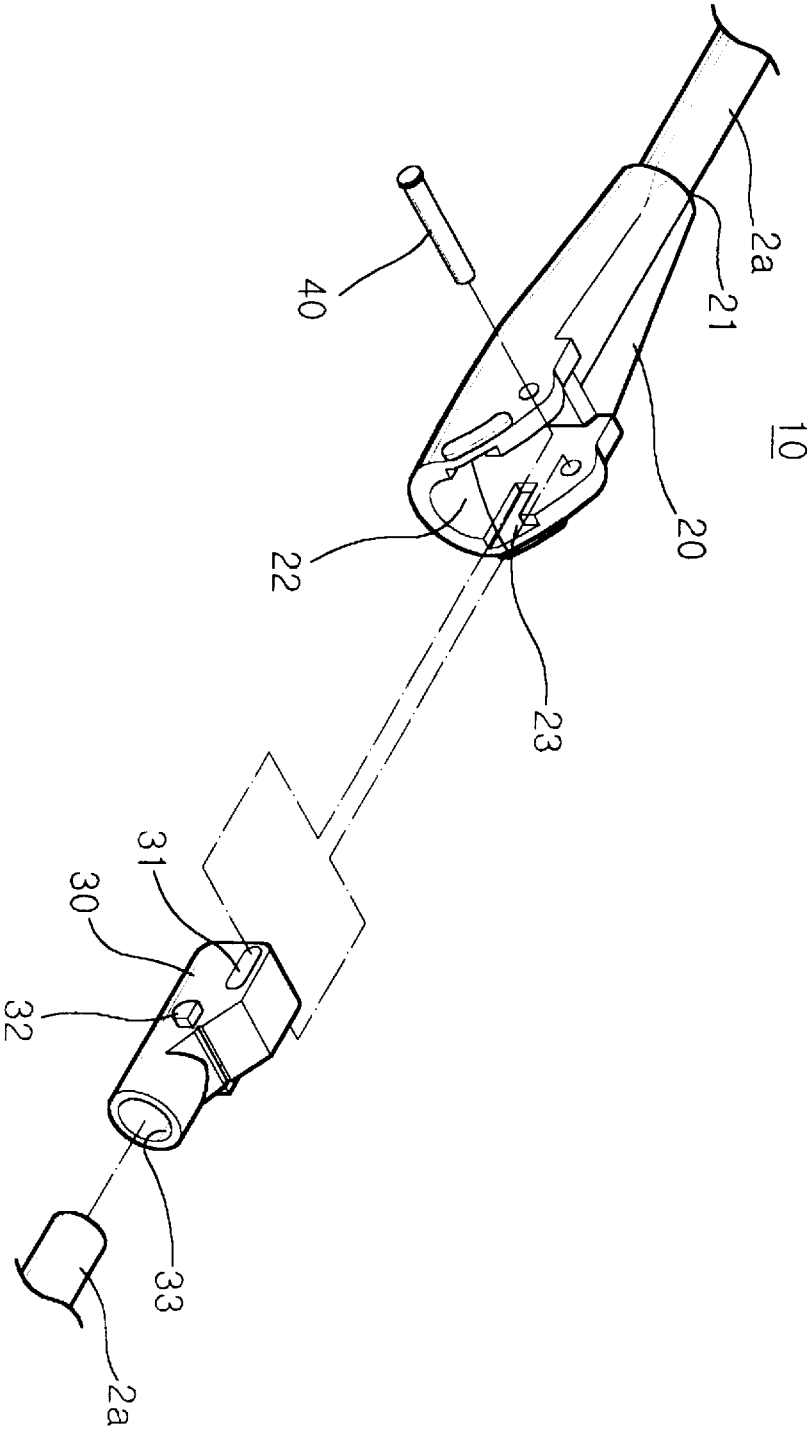
FIG. 2*a* is an exploded perspective view of a conventional pole jointing device included in the tent.
Figure 2B:
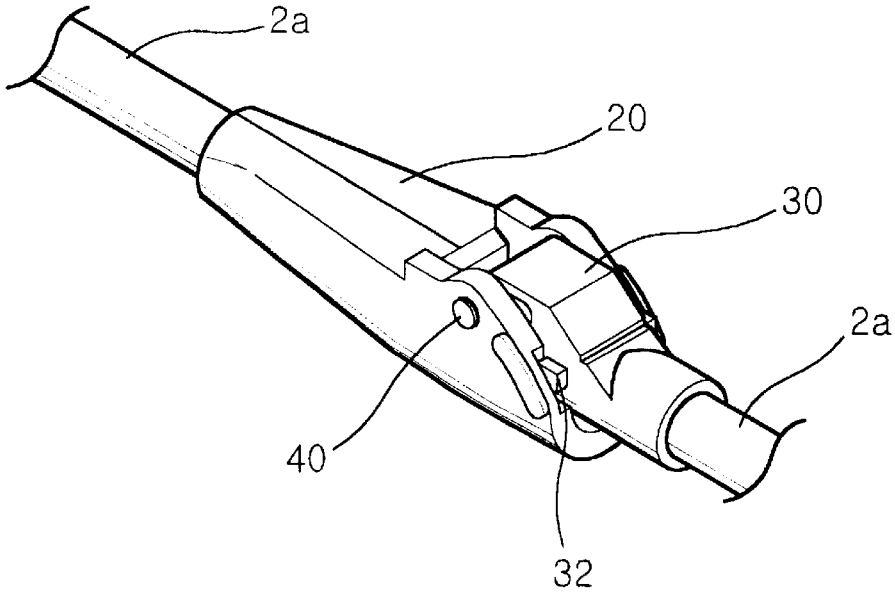
FIG. 2*b* is a perspective view of the conventional pole jointing device of the tent.
Figure 2C:
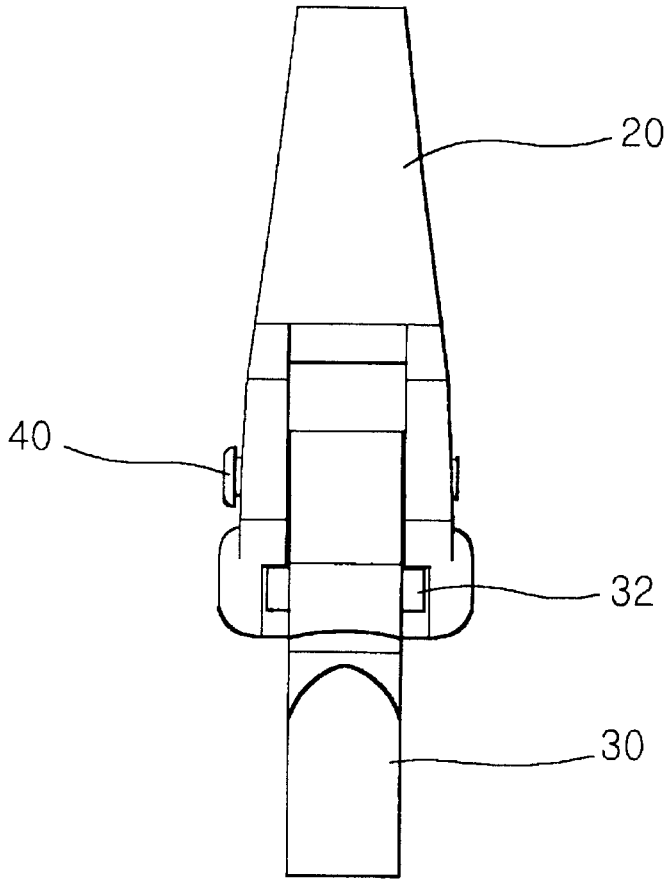
FIG. 2*c* is a plan view of the conventional pole jointing device of the tent.

Reference now should be made to the drawings, in which the same reference numerals are used throughout the different drawings to designate the same or similar components.

Figure 4A:
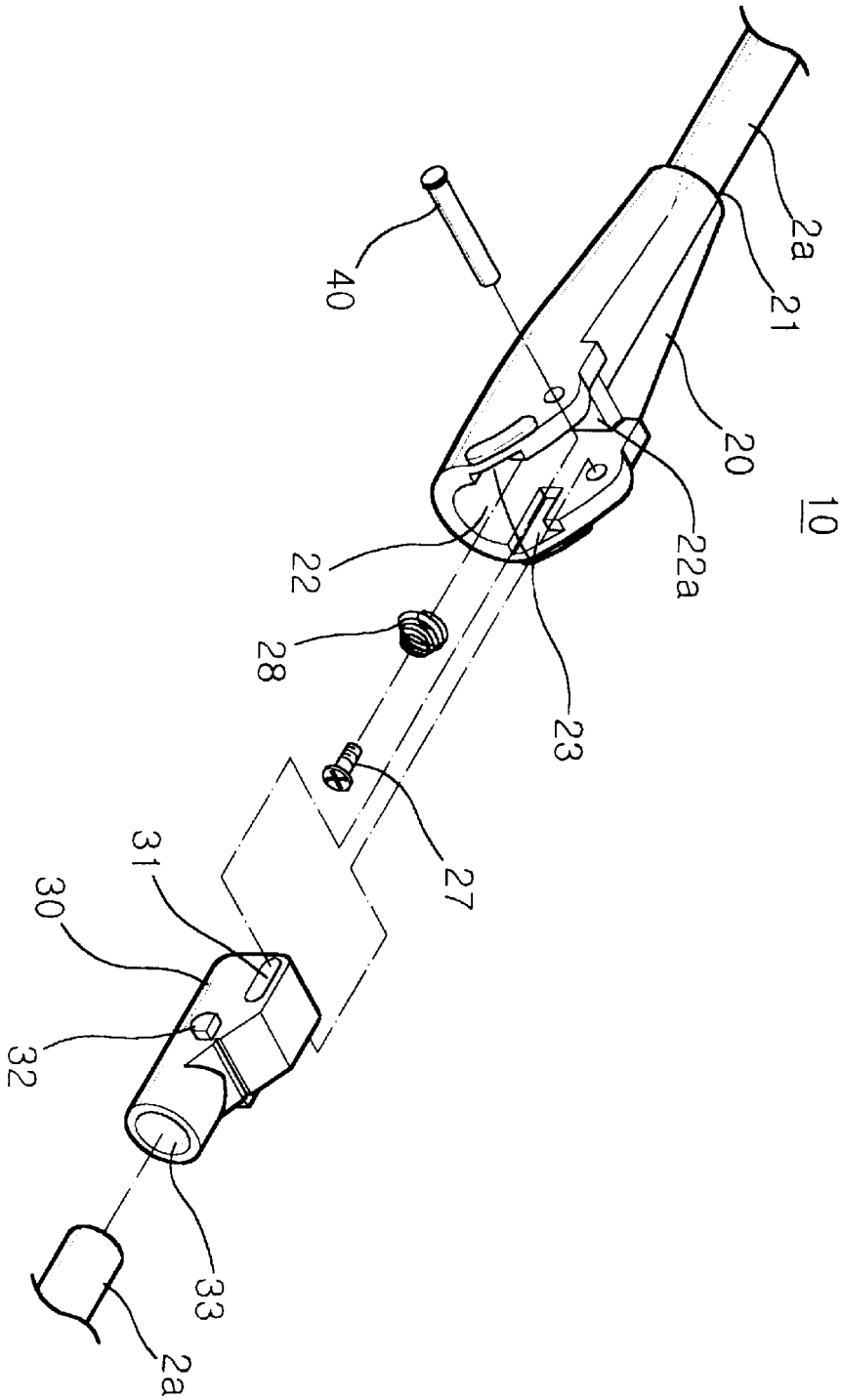
FIG. 4*a* is an exploded perspective view showing a device for jointing poles of a tent in accordance with the present invention.
Figure 4B:
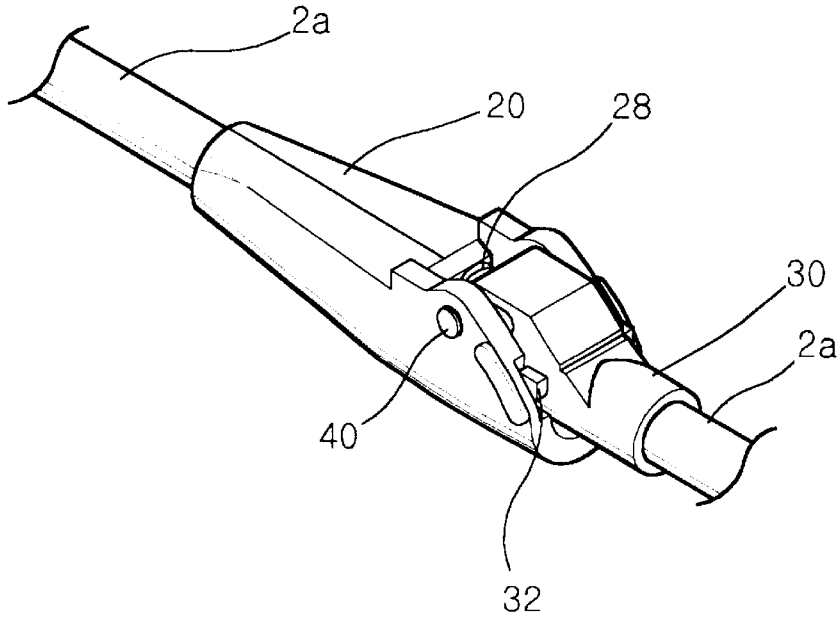
FIG. 4*b* is a perspective view of the device for jointing poles according to this invention.
Figure 4C:
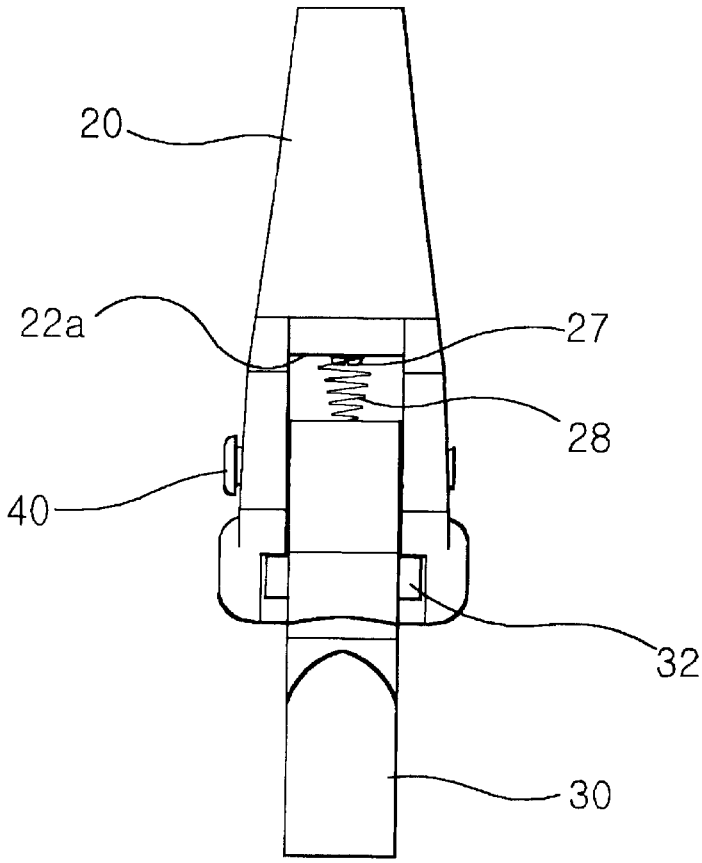
FIG. 4*c* is a plan view of the device for jointing poles according to this invention.

FIG. 4*a*, FIG. 4*b*, and FIG. 4*c* are, respectively, an exploded perspective view, a perspective view, and a plan view, of a device for jointing poles of a tent according to this invention. Similarly to the conventional pole jointing device 10, the device for jointing poles of the tent according to this invention has a housing 20 and a rotor body 30. In this case, the housing 20 consists of a first pole insert hole 21 for receiving a pole 2*a* which forms a pole assembly, a seat slit 22 in which the rotor body 30 is seated, and two locking recesses 23 formed on both sidewalls of the seat slit 22. The rotor body 30 consists of a longitudinal hinge hole 31 for receiving a hinge pin 40. The hinge pin 40 is fitted into the longitudinal hinge hole 31 such that the rotor body 30 seated in the seat slit 22 of the housing 20 is rotatably jointed to the housing 20. Two locking lugs 32 are formed on the rotor body 30, and each is inserted into an associated locking recess 23 of the housing 20 in order to limit the rotation of the rotor body 30 relative to the housing 20. The device for jointing the poles 2*a* of this invention also has a second pole insert hole 33 at the rotor body 30 for receiving another pole 2*a*. The device of this invention is different from the conventional pole jointing device 10 in that it has a unit for automatically releasing, when desired, the rotor body 30 from the housing 20. The automatic releasing unit consists of an elastic member 28 mounted by a locking member 27 to the center portion of the end wall 22*a* formed at the inside end of the slit 22.

Preferably, the locking member 27 may be selected from setscrews, bolts, and others, while the elastic member 28 may be selected from compression springs, tension springs, etc.

The operation of the automatic releasing unit which is included in the pole jointing device of this invention will later be described.

Figure 3:
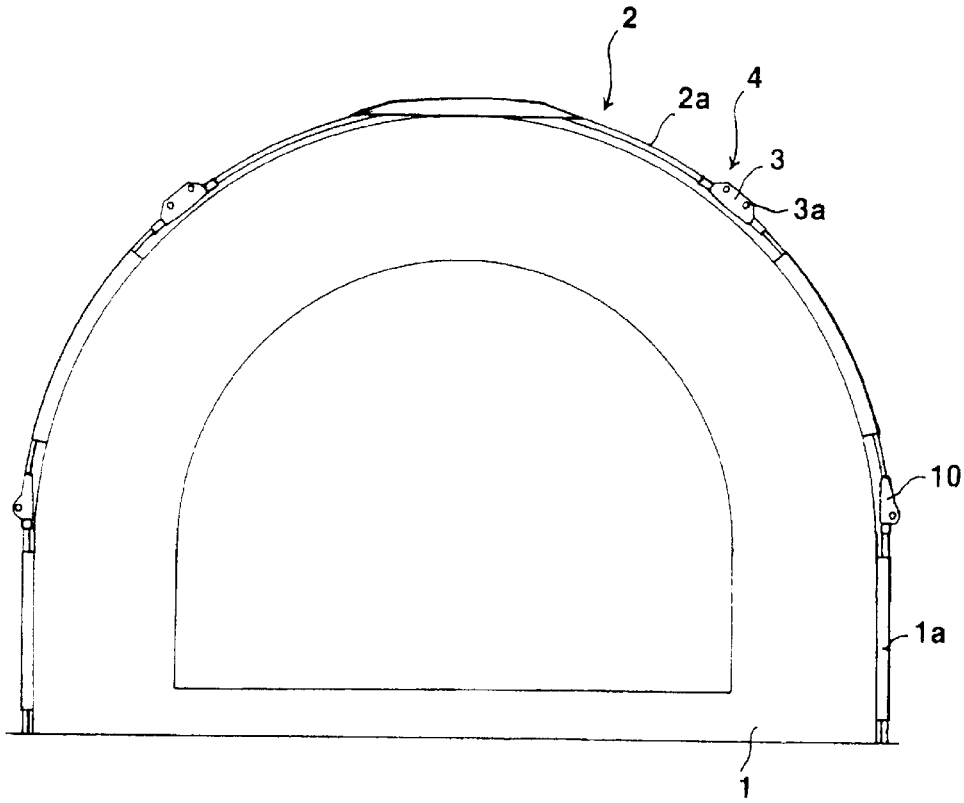
FIG. 3 is a front view of the tent, with the conventional pole jointing device installed on the tent.

When it is required to pitch the main body 1 of the tent using the pole assemblies 2, each formed by connecting the poles 2*a* to each other using coupling members 3 and pole jointing devices 10, as shown in FIG. 3, the rotor body 30 is seated in the seat slit 22 of the housing 20. Simultaneously, the locking lugs 32, formed on the both sidewalls of the rotor body 30, are fitted into the locking recesses 23 of the housing 20, as shown in FIGS. 4*a* to 4*c*.

That is, as shown in FIG. 3, each pole assembly 2 is inserted into the pole assembly insert pockets 1*a* which are sewn to the outer circumferential surface of the main body 1, such that the main body 1 of the tent is pitched into a tunnel shape. At this time, the cloth covering the main body 1 of the tent is stretched out by a pulling force of the pole assemblies 2. On the contrary, the pole jointing force of each pole assembly 2 is retained by the stretching force of the cloth.

As described above, as the pole jointing force of the pole assemblies 2 is retained by the stretching force of the cloth, the first pole 2*a* fitted in the first pole insert hole 21 of the housing 20 and the second pole 2*a* fitted in the second pole insert hole 33 of the rotor body 30 push each other toward the central part of the housing 20.

Thus, the second pole 2*a* connected to the rotor body 30 pushes the rotor body 30 toward the central part of the housing 20, resulting in the end of the rotor body 30 compressing the elastic member 28 mounted to the center portion of the end wall 22*a* while moving toward the end wall 22*a* of the housing 20.

At this time, the locking lugs 32 of the rotor body 30 are fitted into the locking recesses 23 of the housing 20 to prevent an unexpected rotation of the rotor body 30, thus allowing the tent to maintain its desired tunnel shape.

On the other hand, when it is required to collapse the tent, the coupling force of the poles 2*a*, which are coupled with each other to form the pole assembly 2, has to be removed. When the coupling force is removed, the force pushing the poles 2*a* toward the central part of the housing 20 is also removed, so the compressed elastic member 28 is returned to its original position. The elastic restoring force of the elastic member 28 causes the rotor body 30 to move in a direction away from the end wall 22*a* of the housing 20, and simultaneously the locking lugs 32 of the rotor body 30 are automatically removed from the locking recesses 23 of the housing 20.

Therefore, different from the conventional pole jointing device which is designed to necessarily remove the locking lugs 32 of the rotor body 30 from the locking recesses 23 of the housing 20 by pulling the second pole 2*a* connected to the rotor body 30 in such a way as to be spaced from the housing 20, the device of this invention allows the tent to be easily and simply collapsed, because the rotor body 30 is automatically released from the housing 20 by simply rotating the rotor body 30.

As described above, the present invention provides a device for jointing poles of a tent, which has an automatic releasing unit designed to automatically remove locking lugs of a rotor body from locking recesses of a housing by an elastic member, thus preventing the housing or the rotor body from being damaged when collapsing the tent, therefore increasing the useful life of the device, saving maintenance costs, and allowing for easy and convenient collapse of the tent.

Although the preferred embodiments of the present Invention have been disclosed for illustrative purposes, those skilled in the art will appreciate that various modifications, additions and substitutions are possible, without departing from the scope and spirit of the invention as disclosed in the accompanying claims.

What is claimed is:

1. A device for jointing poles of a tent, comprising a housing consisting of a first pole insert hole for receiving a pole, a seat slit in which a rotor body is seated, and a locking recess formed on each sidewall of said seat slit; and a rotor body consisting of a longitudinal hinge hole receiving a hinge pin therein such that the rotor body seated in the seat slit of the housing is rotatably jointed to the housing, a locking lug inserted into an associated locking recess of said housing to limit rotation of the rotor body, and a second pole insert hole for receiving another pole, further comprising:

a unit for automatically releasing the rotor body from the housing, said unit consisting of an elastic member mounted by a locking member to an end wall provided at an inside end of the seat slit, with said elastic member allowing the locking lugs of the rotor body to be automatically removed from the locking recesses of the housing when collapsing the tent.

* * * * *

UNITED STATES PATENT AND TRADEMARK OFFICE

CERTIFICATE OF CORRECTION

PATENT NO. : 6,679,643 B1
DATED : January 20, 2004
INVENTOR(S) : Se Il Ham

It is certified that error appears in the above-identified patent and that said Letters Patent is hereby corrected as shown below:

Title page,
Item [73], Assignee's name should read -- Northpole Limited, Tsim Sha Tsui (HK) --

Signed and Sealed this

Seventh Day of September, 2004

JON W. DUDAS
*Director of the United States Patent and Trademark Office*